US007810291B2

(12) United States Patent
McPherson

(10) Patent No.: US 7,810,291 B2
(45) Date of Patent: Oct. 12, 2010

(54) CONNECTABLE DRAINAGE DEVICE

(76) Inventor: Kevin McPherson, 9579 Hess Rd., Edwardsville, IL (US) 62025

( * ) Notice: Subject to any disclaimer, the term of this patent is extended or adjusted under 35 U.S.C. 154(b) by 0 days.

(21) Appl. No.: 12/018,112

(22) Filed: Jan. 22, 2008

(65) Prior Publication Data

US 2009/0183445 A1 Jul. 23, 2009

(51) Int. Cl.
*E04F 17/00* (2006.01)

(52) U.S. Cl. ..... 52/302.3; 52/302.1; 52/302.6; 52/62; 52/61; 404/2; 405/36; 405/38; 405/43; 405/45; 405/49; 405/50; 428/178; 428/179

(58) Field of Classification Search ..... 52/169.1, 52/169.5, 169.14, 169.11, 288, 58, 61–62, 52/532–534, 303, 272–278, 287, 287.1, 302.3, 52/302.1, 302.6; 404/2, 4; 405/36, 43–44, 405/48, 38, 45, 50; 428/178–180
See application file for complete search history.

(56) References Cited

U.S. PATENT DOCUMENTS

| | | | | |
|---|---|---|---|---|
| 3,283,460 | A | | 11/1966 | Patrick |
| 3,850,193 | A | | 11/1974 | Guzzo |
| 3,852,925 | A | | 12/1974 | Gazzo |
| 3,888,087 | A | | 6/1975 | Bergsland |
| 4,045,964 | A | | 9/1977 | Barclay |
| 4,245,443 | A | | 1/1981 | Beechen |
| 4,381,630 | A | | 5/1983 | Koester |
| 4,604,842 | A | | 8/1986 | Sukup |
| 4,674,249 | A | | 6/1987 | Bennett, Jr. |
| 4,715,743 | A | | 12/1987 | Schmanski |
| 4,730,953 | A | | 3/1988 | Tarko |
| 4,745,716 | A | * | 5/1988 | Kuypers ..... 52/169.5 |
| 4,837,991 | A | | 6/1989 | Shaw |
| 4,840,515 | A | | 6/1989 | Freese |
| 4,869,032 | A | * | 9/1989 | Geske ..... 52/169.5 |
| 4,925,342 | A | | 5/1990 | Hendy |
| 4,943,185 | A | * | 7/1990 | McGuckin et al. ..... 405/45 |
| 4,956,951 | A | | 9/1990 | Kannankeril |
| 5,030,343 | A | | 7/1991 | Urriola |
| 5,044,821 | A | * | 9/1991 | Johnsen ..... 405/50 |
| 5,051,044 | A | | 9/1991 | Allen |
| 5,052,161 | A | | 10/1991 | Whitacre |
| D329,297 | S | | 9/1992 | Smith |
| 5,184,437 | A | | 2/1993 | Woong et al. |
| 5,256,007 | A | | 10/1993 | Allen |
| 5,303,669 | A | | 4/1994 | Szekely |
| 5,399,406 | A | | 3/1995 | Matsuo et al. |
| 5,460,867 | A | * | 10/1995 | Magnuson et al. ..... 428/178 |
| 5,489,462 | A | | 2/1996 | Sieber |
| 5,501,044 | A | | 3/1996 | Janesky |
| 5,619,832 | A | | 4/1997 | Myrvold |
| 5,692,348 | A | | 12/1997 | Ambrosino |
| 5,771,643 | A | | 6/1998 | Parker |
| 5,775,039 | A | | 7/1998 | McPherson |
| 6,241,421 | B1 | | 6/2001 | Harvie et al. |
| D456,911 | S | | 5/2002 | Janesky |
| 6,672,016 | B2 | * | 1/2004 | Janesky ..... 52/169.5 |
| 2005/0198916 | A1 | | 9/2005 | Janesky |

* cited by examiner

*Primary Examiner*—Jeanette Chapman
(74) *Attorney, Agent, or Firm*—Senniger Powers LLP

(57) ABSTRACT

A drainage tile used on a footing of a foundation to promote drainage of water along the footing and away from a foundation wall. The drainage tile comes in lengths that are less than the length of the footing. The drainage tile can be secured together with other drainage tiles to span the length of the footing.

10 Claims, 10 Drawing Sheets

CONNECTABLE DRAINAGE DEVICE

BACKGROUND

This invention relates generally to drainage systems and more particularly to drainage devices for use in providing a flow path below basement floors for water seeping in between foundation walls and footing to prevent water leakage onto basement floors.

A problem in many basements is that of wet or damp basement floors caused by water seeping under the foundation wall and flowing up between the foundation wall and the basement floor. It is not practical, or even desirable, to prevent water from seeping under the foundation wall. Water pressure build up behind the wall can damage the wall. Therefore, drainage systems are used to provide a flow path for water entering between the foundation wall and footing to a sump, thus preventing the water from flowing up between the foundation wall and basement floor.

Presently available drainage systems include drainage devices in the form of tiles, over which the basement concrete floor is poured. Prior drainage devices, such as those shown in U.S. Pat. No. Des. 329,297 and U.S. Pat. No. 4,745,716, have a flat wall member and a plurality of feet extending downward therefrom and engaging the footing to create flow paths for the water between the floor and footing. My own U.S. Pat. No. 5,775,039 (the disclosure of which is hereby incorporated by reference) discloses a drainage tile that is clear so that the passages under the drainage tile can be inspected just prior to pouring concrete to locate any blockage that could prevent water from flowing along the footing as desired. Any blockage that is seen can be removed prior to pouring the concrete. The drainage tiles come in sections that are smaller in length than the length of a footing. Therefore, the tiles have to overlay each other to span the entire length of the footing without gaps in the water flow passage.

SUMMARY

In one aspect of the invention, a drainage device is used under a floor in a structure including the floor, a foundation wall, and a footing located below the foundation wall. The drainage device is constructed for placement on the footing adjacent to the foundation wall prior to installation of the floor to permit water to flow along the footing under the floor. The drainage device generally comprises a wall member having a first surface facing away from at least one of the footing and foundation wall when the drainage device is placed on the footing, and a second surface facing generally toward at least one of the footing and foundation wall when the drainage device is placed on the footing. A plurality of protrusions project outwardly from the second surface of the wall member and open at the first surface of the wall member. At least some of the protrusions are connecting protrusions sized and shaped for an interference fit with connecting protrusions of another drainage device having the same construction so that when the drainage devices are overlapped they are connected together in a close conforming relation.

In another aspect of the present invention, a drainage device is used under a floor in a structure including the floor, a foundation wall, and a footing located below the foundation wall. The drainage device is constructed for placement on the footing adjacent to the foundation wall prior to installation of the floor to permit water to flow along the footing under the floor. The drainage device generally comprises a wall member having a first surface facing away from at least one of the footing and foundation wall when the drainage device is placed on the footing, and a second surface facing generally toward at least one of the footing and foundation wall when the drainage device is placed on the footing. A plurality of protrusions project outwardly from the second surface of the wall member and open at the first surface of the wall member. The wall member includes a wall section positioned for lying adjacent to the foundation wall. The wall section has a generally flat finish segment arranged to be positioned at the top surface of the floor to facilitate smooth finishing of the floor at the foundation wall.

BRIEF DESCRIPTION OF THE DRAWINGS

Corresponding reference characters indicate corresponding parts throughout the several views of the drawings.

DETAILED DESCRIPTION OF ILLUSTRATED EMBODIMENT

Figure 1:
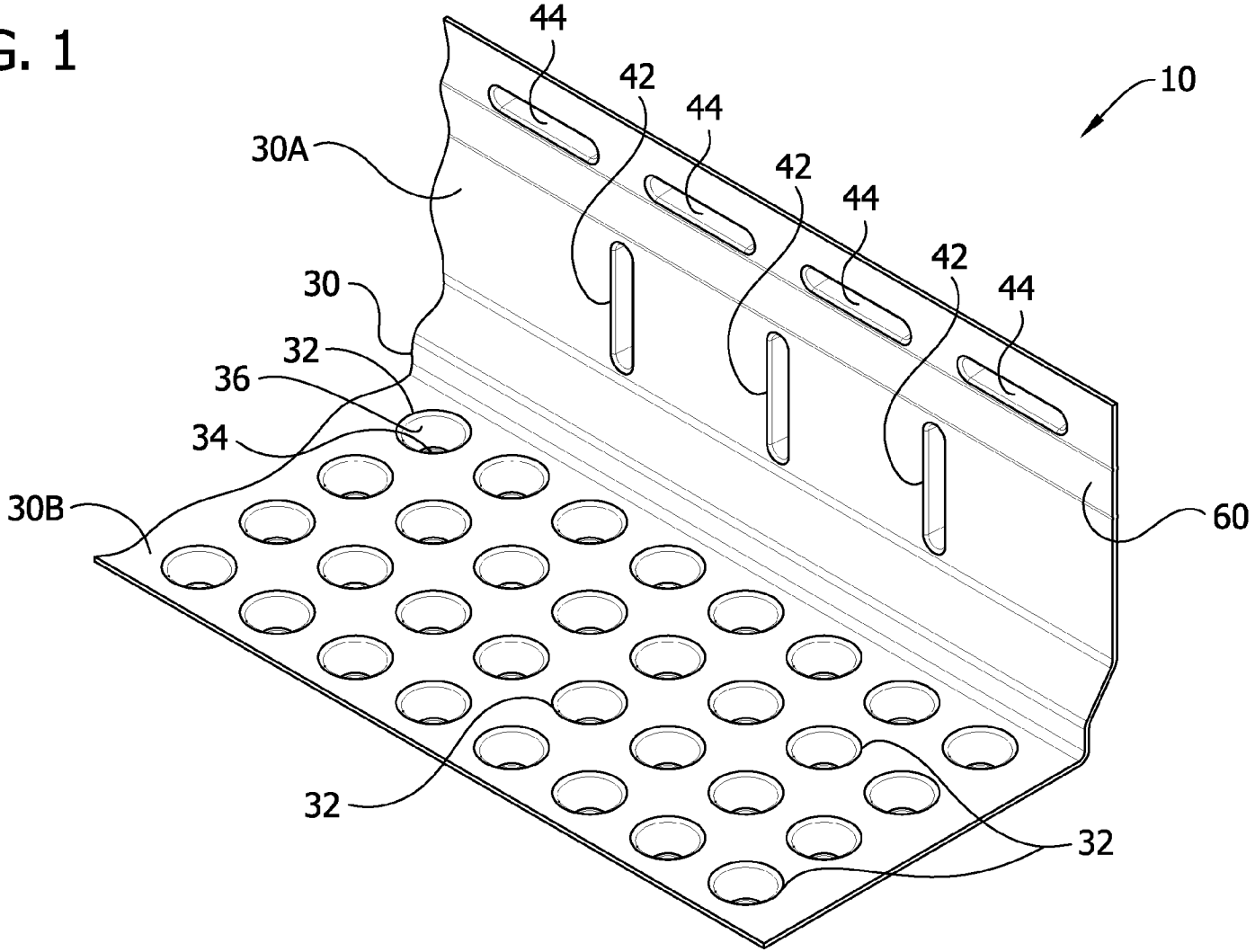
FIG. 1 is a fragmentary perspective of a drainage tile of the present invention.

Referring now to the drawings, and first to FIGS. 1-4, there is generally indicated at 10 a drainage tile of this invention (broadly, "drainage device"). The drainage tile 10 is for use under a floor 12 in a structure (e.g., a residence) including the floor, a foundation wall 14, and a footing 16 located below the foundation wall (see, FIG. 4). A drain or sump (not shown) may be located along the foundation to receive the drained water. The drainage tile 10 is constructed for placement on the footing 16 adjacent to the foundation wall 14 prior to installation of the floor 12 to permit water to flow along the footing under the floor. The structure can be formed in a conventional manner with the footing 16 and foundation wall 14 typically formed of concrete. As will be understood by those of ordinary skill in the art, other materials can be used. For example, cinder blocks (not shown) may be used for the foundation wall. The footing 16 extends around the perimeter of the structure and supports the foundation wall 14. The footing 16 also extends beyond the foundation wall into the interior of the structure for supporting a peripheral edge of the basement floor 12 at the outer perimeter of the floor. The remaining portion of the floor 12 is supported by a layer of gravel and dirt generally indicated at 20. The drainage tile 10 may be used in buildings such as residential houses, commercial buildings, factories or any other building having a similar structural arrangement.

Figure 2:
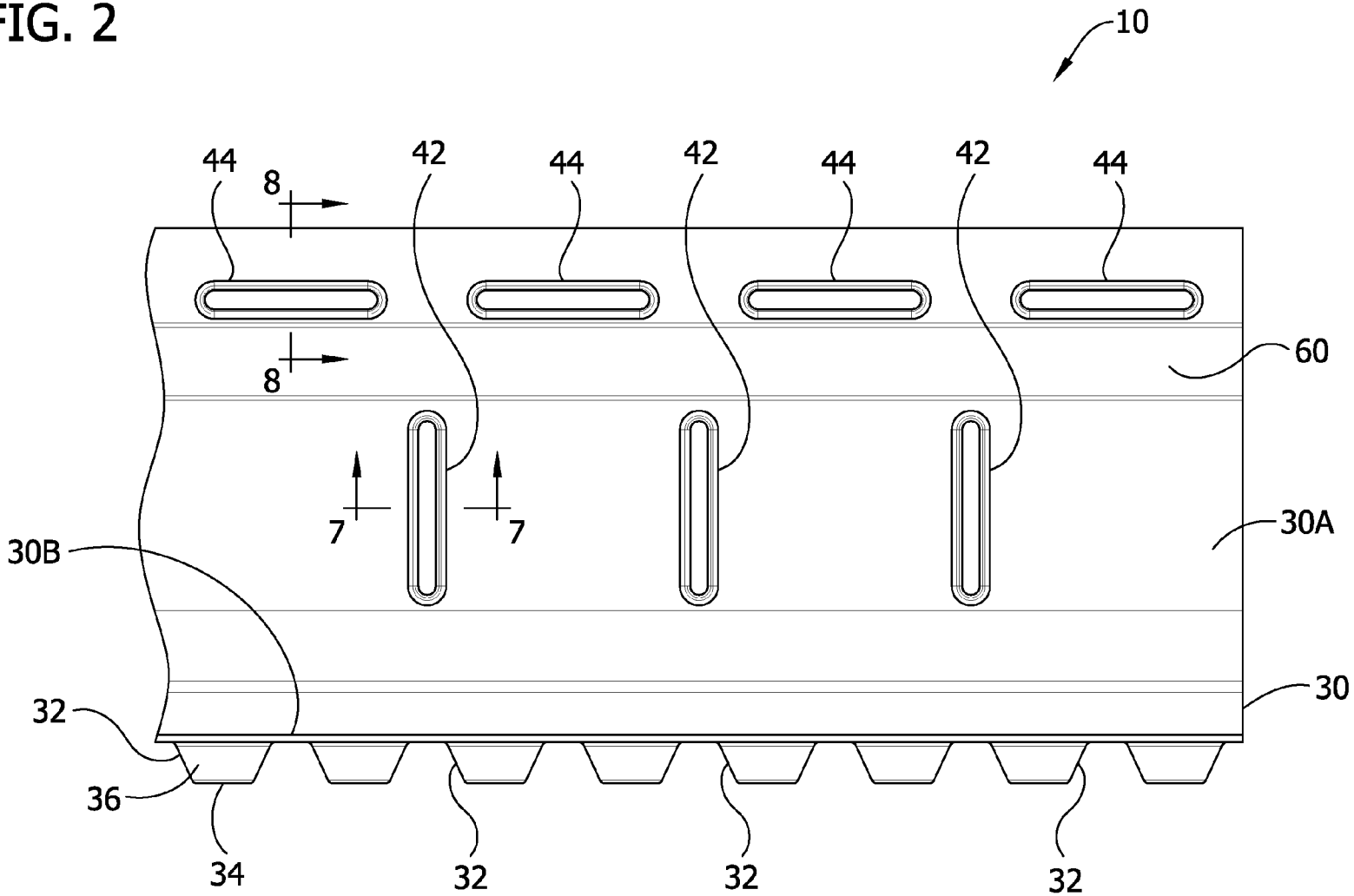
FIG. 2 is a fragmentary front elevation thereof.
Figure 3:
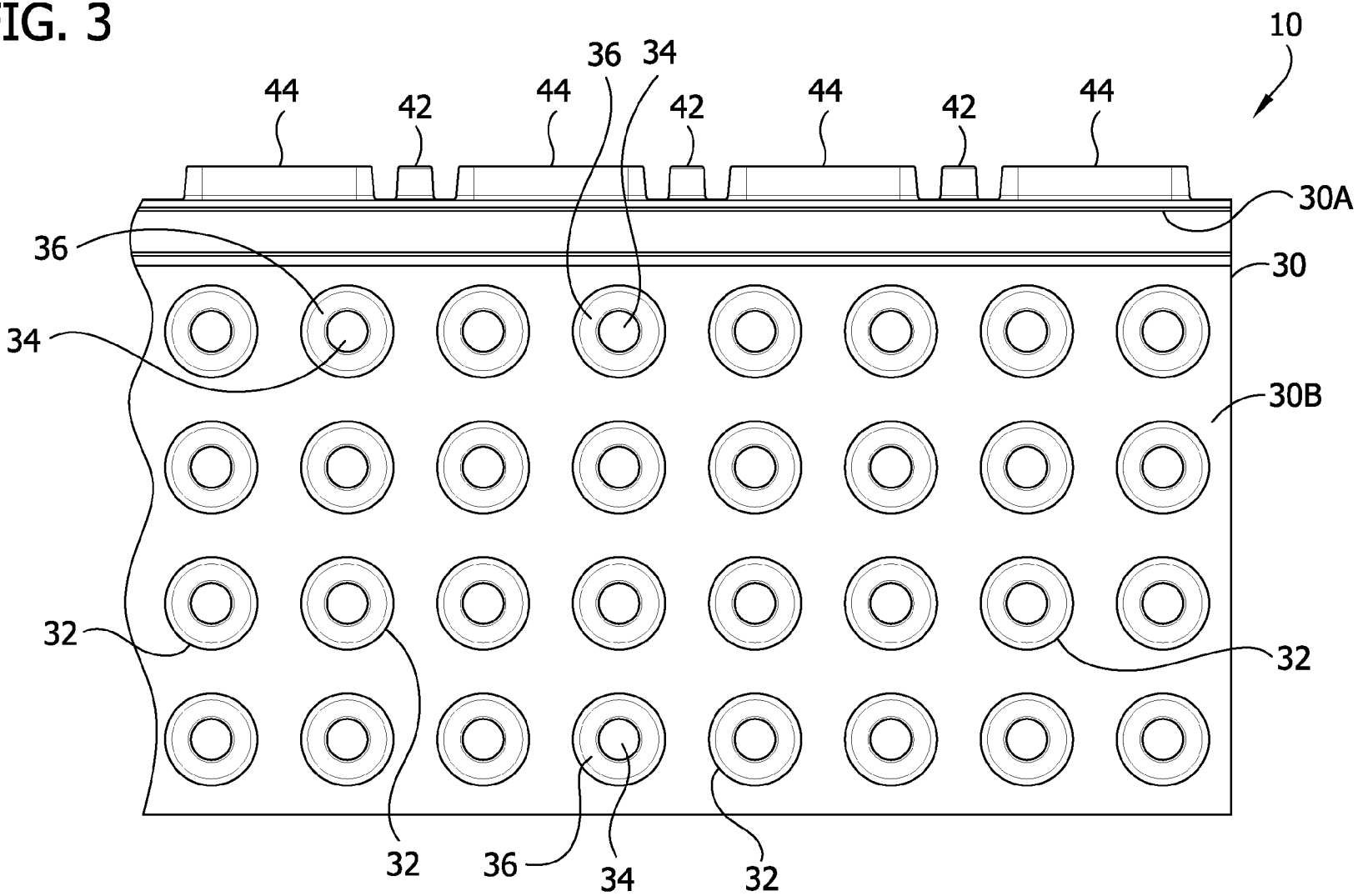
FIG. 3 is a fragmentary top view thereof.
Figure 4:
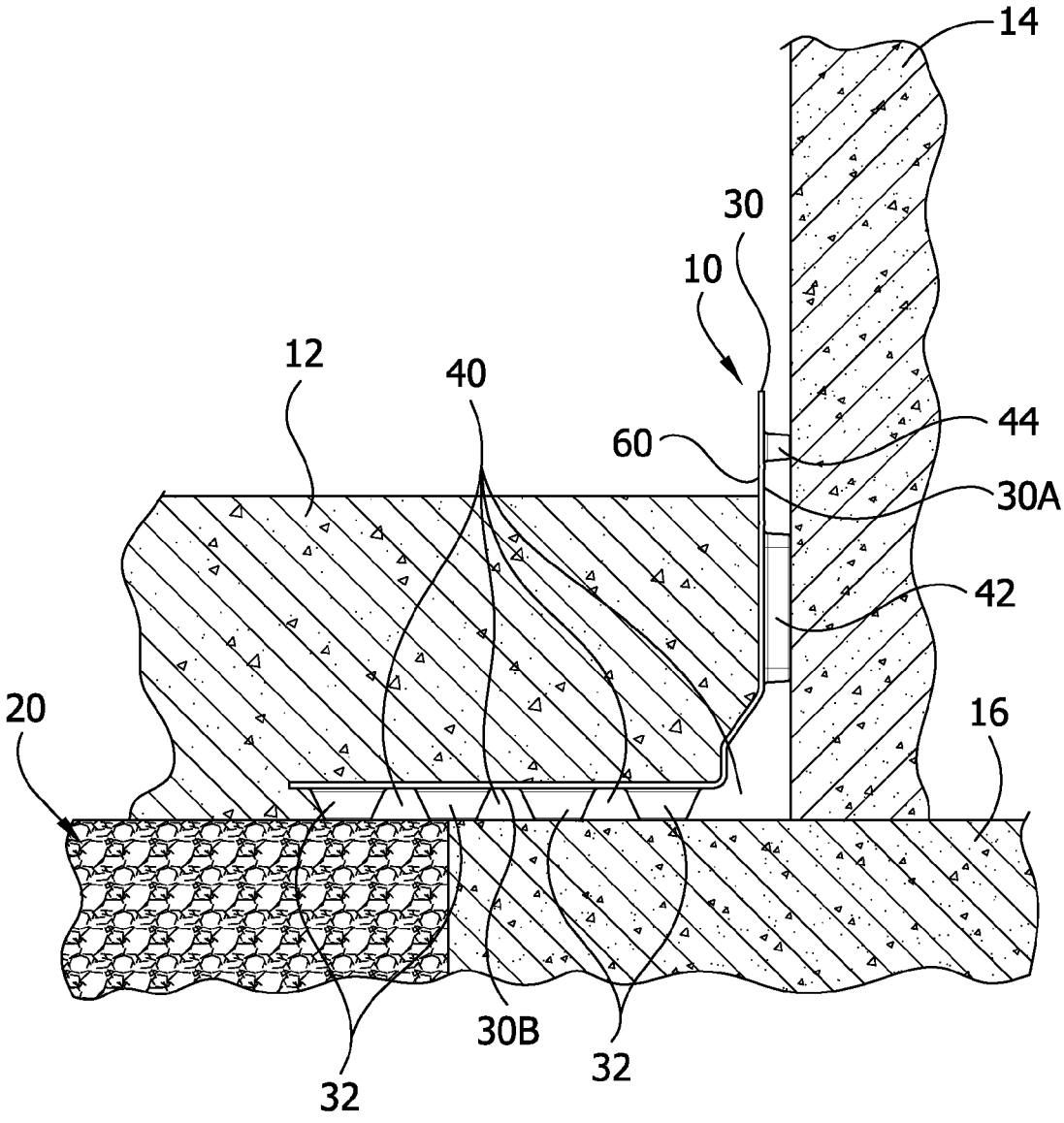
FIG. 4 is a side elevation of the drainage tile as installed on a footing of a foundation of a structure.

The drainage tile 10 comprises a wall member 30 including a wall section 30A that is located adjacent to the foundation wall 14, and a footing section 30B that is located generally adjacent to the footing when the drainage tile is placed on the footing. In one embodiment, the angle between the wall section 30A and the footing section 30B is about 115°. Other angles may be used within the scope of the present invention, but there is some advantage to having the angle be greater than 90° so that the wall sections 30A, 30B are deflected from a relaxed condition as installed on the footing 16. A first surface of the wall member 30 faces generally away from the foundation wall 14 and/or footing 16, and a second surface of the wall member faces generally toward the foundation wall and/or footing. The wall member 30 includes protrusions that project outwardly from the second surface of the wall member and open at the first surface. The protrusions include spaced apart feet 32 depending from the footing section 30B of the wall member 30. The wall member 30 is preferably rectangular in shape and has a width greater than the distance from the foundation wall 14 to the end of the footing 16. The feet 32 are hollow and open upwardly through the first surface of the wall member 30 for receiving material poured to form the floor 12 whereby the weight of the floor is supported by the floor material within the feet and not by the wall member. Each foot 32 comprises a bottom wall 34 and a sidewall 36 which is generally frustoconically shaped (although the sidewall may having other shapes such as cylindrical), as can be seen in FIGS. 2 and 4. It is to be understood that the feet 32 may be rectangular or other suitable shapes without departing from the scope of this invention. The bottom walls 34 of the feet 32 are generally parallel with the wall member 30 and are engageable with the footing 16 at spaced apart locations for vertically spacing the wall member from the footing.

The feet 32 define fluid flow channels 40 for water seeping from between the foundation wall 14 and the footing 16 and allow water to flow freely underneath the floor 12 and along the footing, either into the gravel or to the drain. The placement of the feet 32 is such that the flow channels 40 allow water to travel both longitudinally and laterally with respect to each foundation wall 14. The size and number of feet 32 may vary as long as there is enough surface area provided by the feet to allow for adequate support for the wall member 30 upon pouring the floor material over the drainage tiles 10. It is to be understood that the feet 32 may vary in size and spacing without departing from the scope of this invention. The height of the feet 32 should be large enough to provide adequate flow rates through the flow channels 40 so that under worse case conditions the water will be permitted to flow freely without causing pressure to build up due to water entering the structure at a faster rate than it can be removed. The wall member 30 and feet 32 are preferably integrally formed from a thin (e.g., 0.04 in.) single sheet of material (e.g., ptherlate glycol, "PETG" plastic). The drainage tile 10 may be formed from a polymeric material or other suitable material which is impervious to water and strong enough to retain its shape after the concrete floor is poured and until the floor 12 sets. The drainage tile 10 is preferably sized to extend outwardly beyond the footing 16 so that a portion of the drainage tile 10 covers the rock 20 to permit flow of water between the footing and the rock (FIG. 4). The drainage tile 10 may be formed of a material capable of transmitting light in the visual range or may be opaque.

The wall section 30A of the of the wall member 30 also has protrusions in the form of vertical, elongate channels 42 and horizontal, elongate channels 44 spaced along the length of the drainage tile 10. As will be explained more fully below, the vertical and horizontal channels 42, 44 constitute "connecting protrusions" in the illustrated embodiment. The use of the terms "vertical" and "horizontal" are for convenience and describe the position of the channels 42, 44 when the drainage tile 10 is installed on the footing 16. However, channels may have other orientations without departing from the scope of the present invention. For example, the channels may be other than vertical and horizontal, the channels may all be oriented in the same direction, or some channels may be eliminated altogether. Still further and without limiting the generality of the disclosure, the channels may not necessarily be elongate, and may have different shapes from each other.

Figure 7:
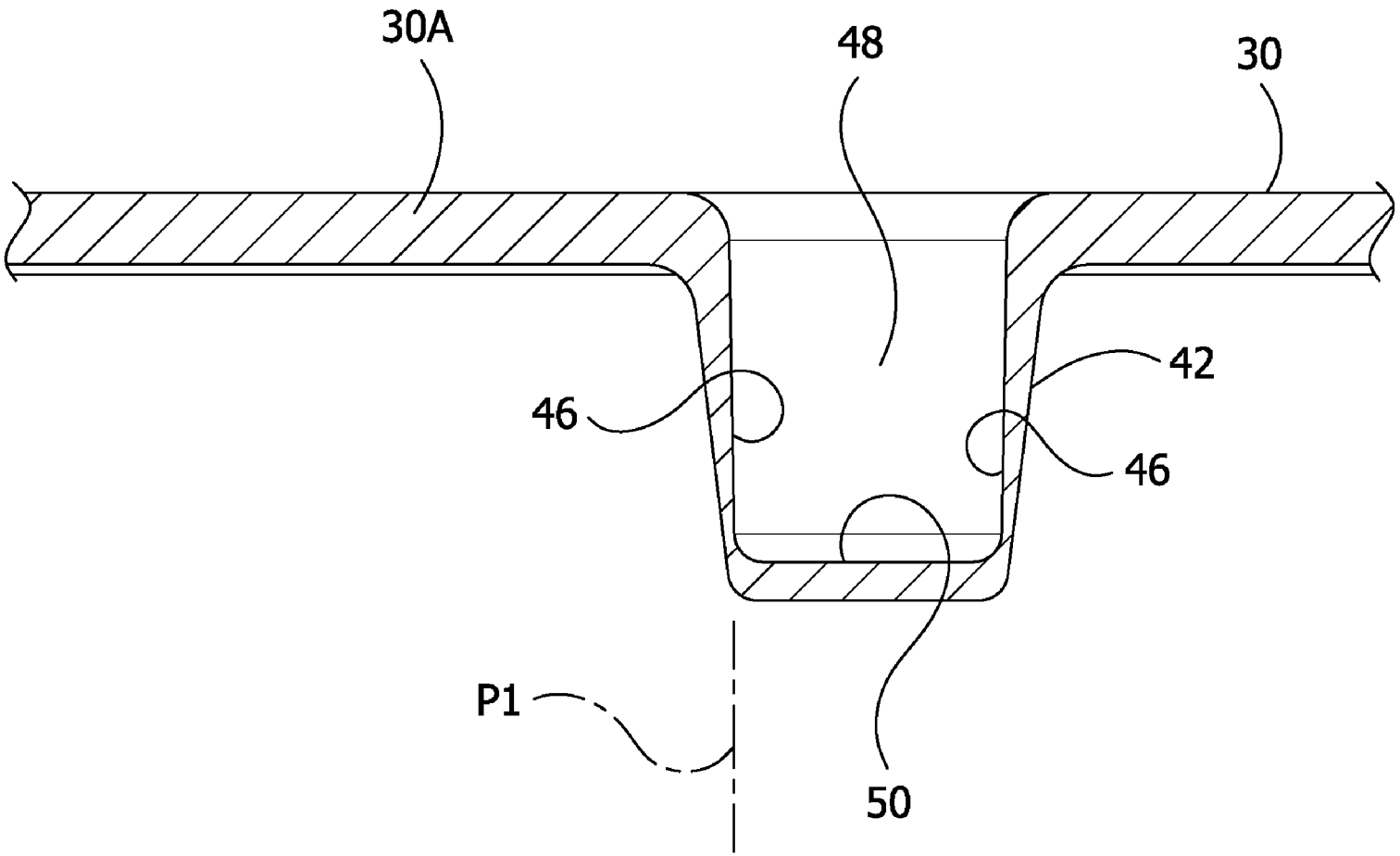
FIG. 7 is a fragmentary section taken in the plane including line 7-7 of FIG. 2.
Figure 8:
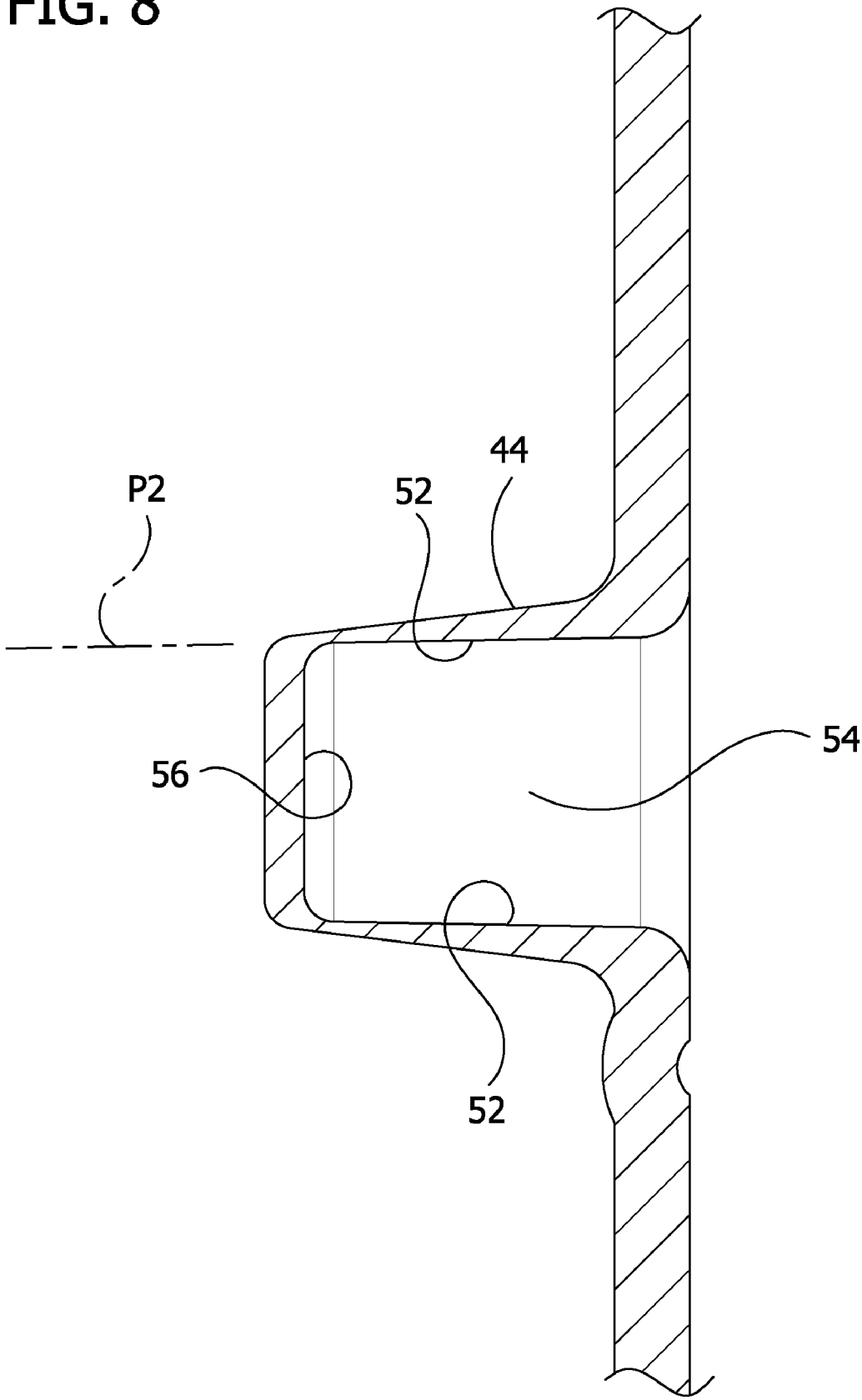
FIG. 8 is a fragmentary section taken in the plane including line 8-8 of FIG. 2.

As shown in FIG. 7, the vertical channels 42 each have side walls 46, end walls 48 (only one is shown) and a bottom wall 50. The angle that the side walls 46 make with a plane P1 perpendicular to the second surface of the wall member 30 and roughly parallel to the side wall is preferably small. For example, in one embodiment, the angle may range from 0° to 45°, in another embodiment may range from 0° to 15°, and in still another embodiment may range from 0° to 10°. It is understood that some small angle may be necessary to get the drainage tile 10 out of a mold (not shown) in which it is formed, but otherwise the angle is most preferably close to 0° (or 90° from the wall section 30A), which is what is illustrated in FIG. 7. As a result, the opening of each vertical channel 42 at the first surface of the wall section 30A of the wall member 30 is nearly the same size as (but very slightly larger than) the bottom wall 50. In the illustrated embodiment, the end walls 48 each make a similar angle with respect to a plane (not illustrated) perpendicular to the second surface of wall member 30 and tangent to the end wall. However, it is not necessary for both walls to make the same angle. For instance, the upper one of the end walls 48 may make a greater angle than the lower one of the end walls. As shown in FIG. 8, the horizontal channels 44 each have side walls 52, end walls 54 and a bottom wall 56 similar to the construction of the vertical channels 42. The side walls 52 preferably make an angle with a plane P2 that is perpendicular to the second surface of the wall section 30A of the wall member 30 and roughly parallel to the side wall that is small. The ranges of angles given for the vertical channel 42 may be applied to the horizontal channels 44, and the illustrated angle is about 0°. The walls do not all need to have the same angle. For example, the upper one of the side walls 52 may have a greater angle than the lower one of the side walls. Again the opening of the horizontal channel 44 at the first surface of the wall member 30 is very nearly the same size (but probably slightly larger than) the bottom wall 56 of the horizontal channel. It will be noted that the exterior surfaces of the vertical channels 42 and the horizontal channels 44 are tapered toward the bottom walls 50, 56 (e.g., they make a non-zero angle with respective planes P1 and P2). This facilitates nesting of channels as will be described. In the illustrated embodiment, the vertical channels 42 are about 2⅛ inches long and about ⅜ inches wide. The horizontal channels 44 are about 1¾ inches long and ⅜ inches wide. It is to be understood that these dimensions are exemplary only, and the channels 42, 44 may have other dimensions within the scope of the present invention.

Figure 5:
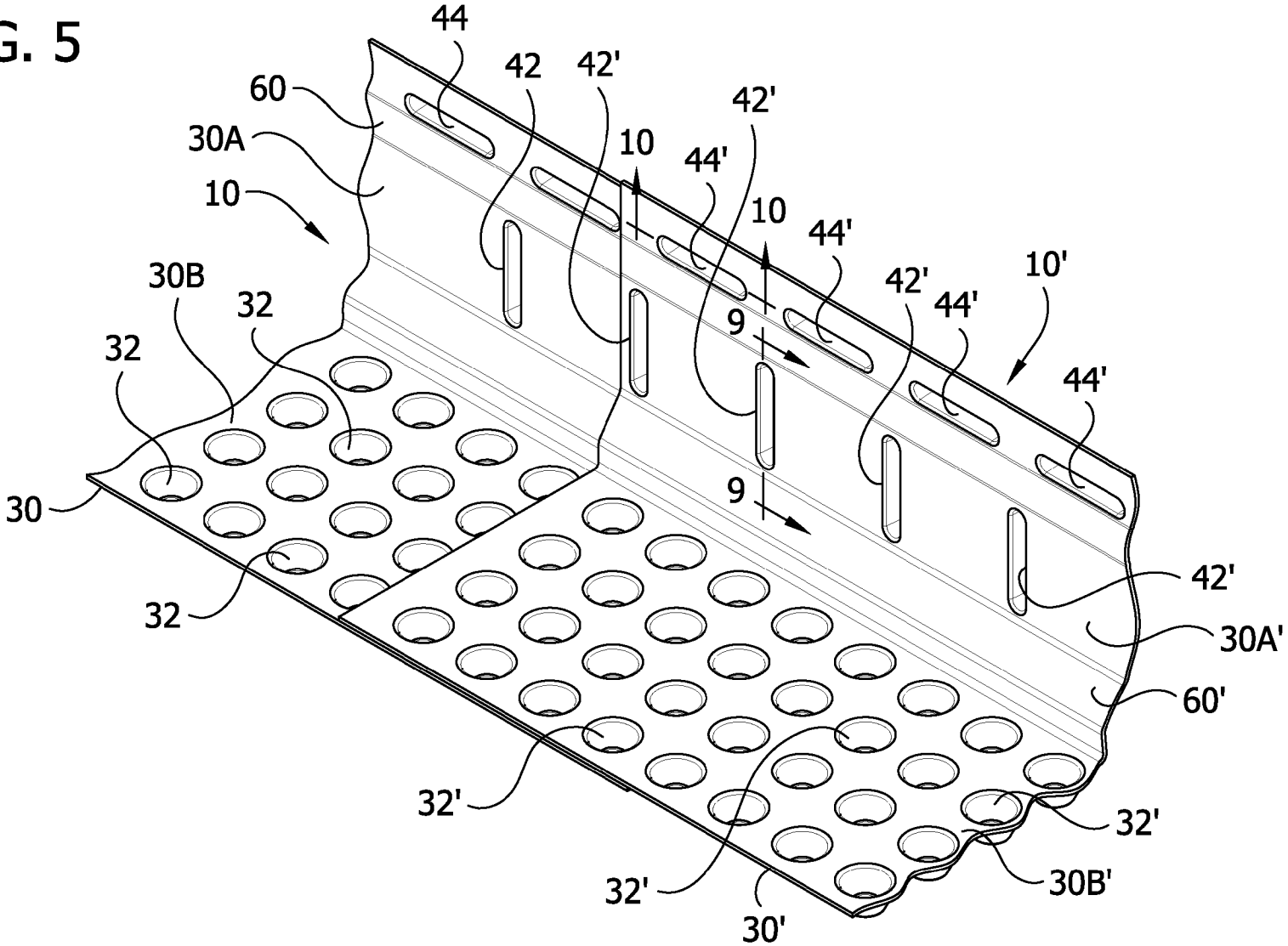
FIG. 5 is a fragmentary perspective of two, overlapped drainage tiles.
Figure 6:
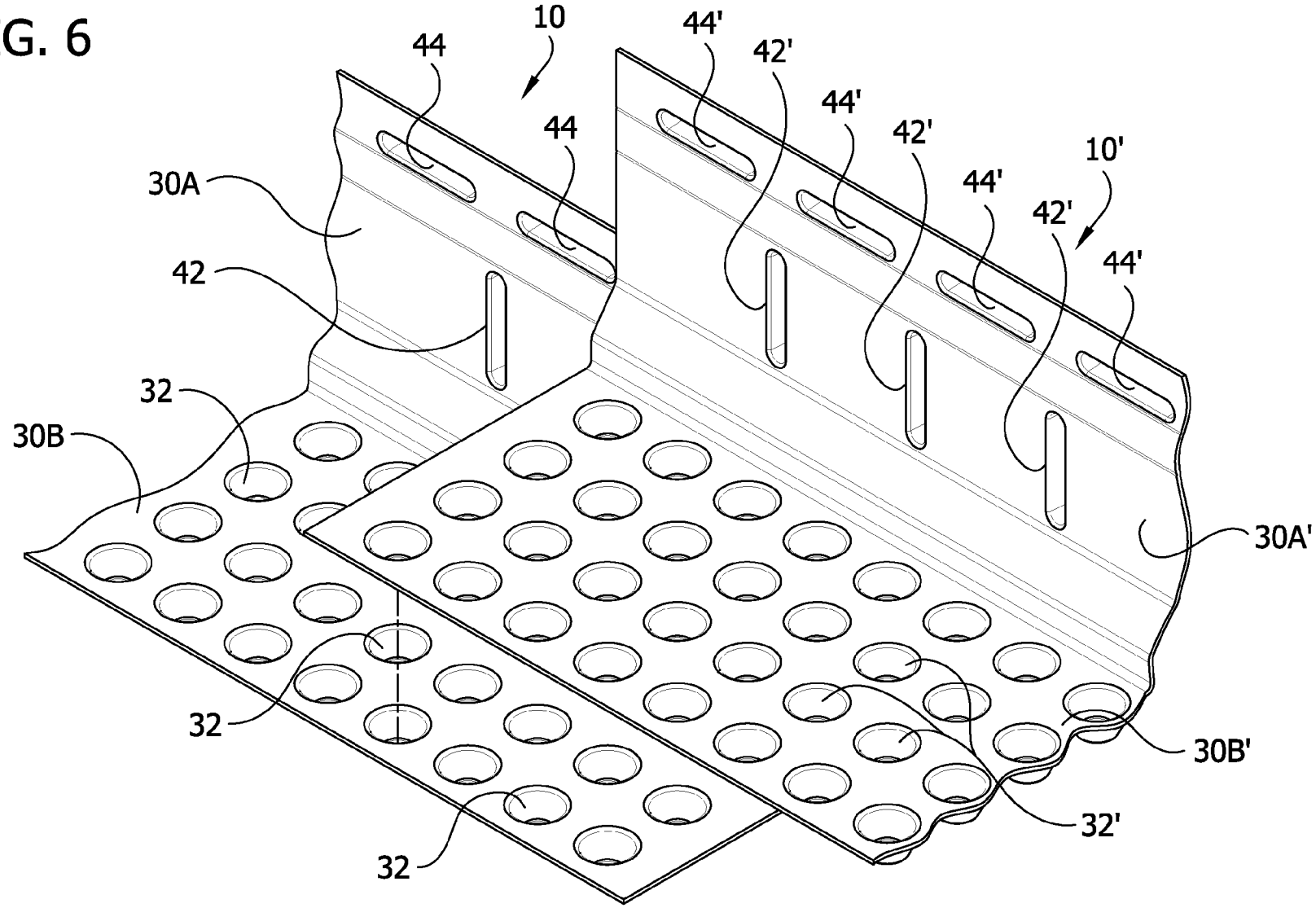
FIG. 6 is the perspective of FIG. 5, but with the drainage tiles exploded from one another.
Figure 9:
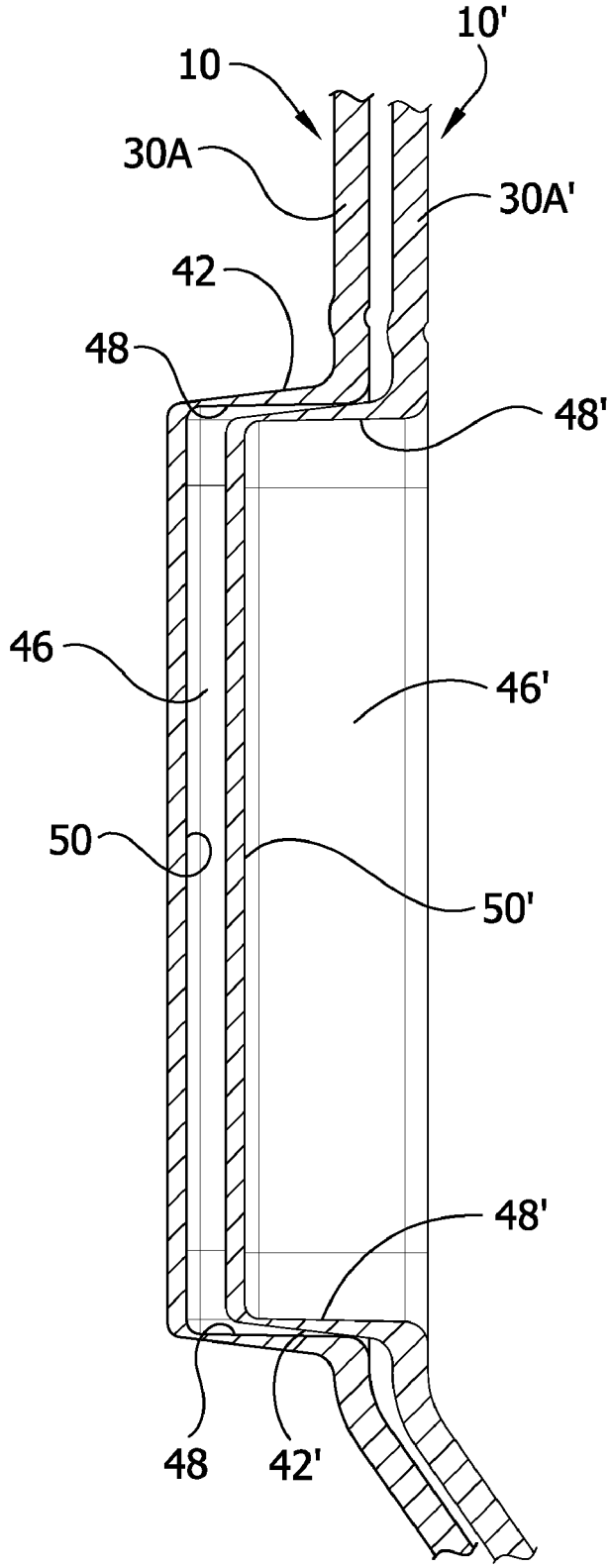
FIG. 9 is a fragmentary section taken in the plane including line 9-9 of FIG. 5.
Figure 10:
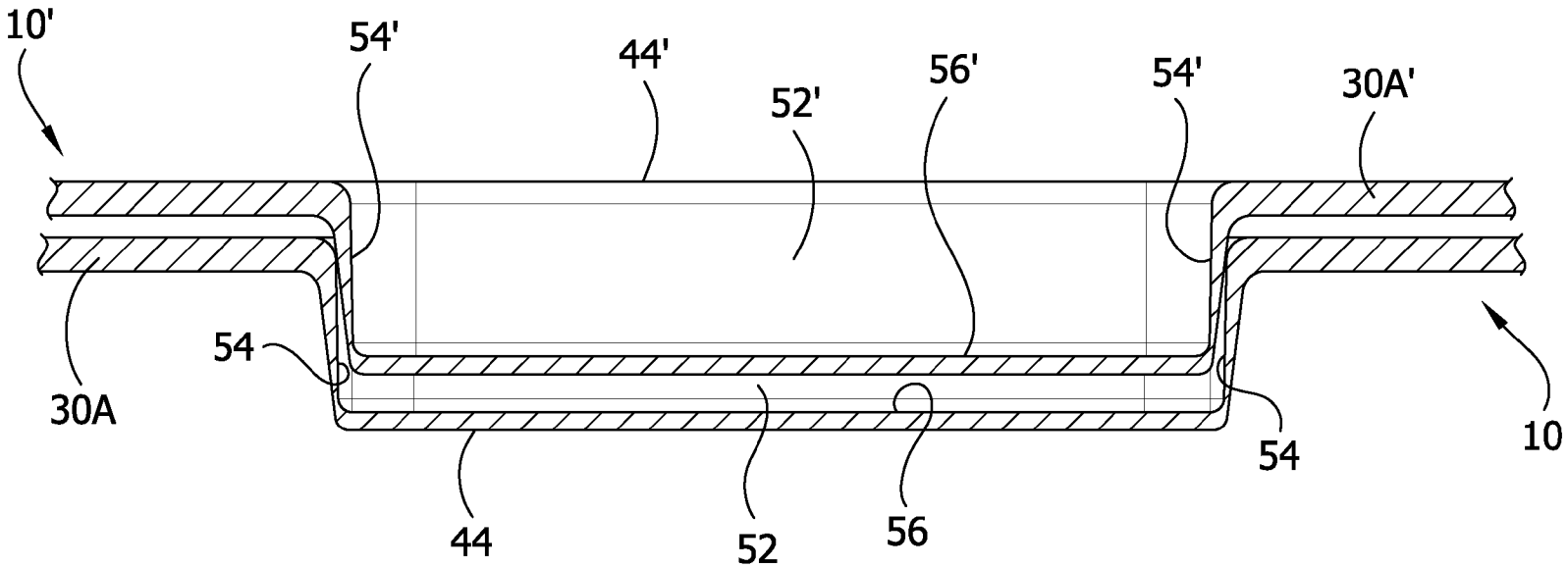
FIG. 10 is a fragmentary section taken in the plane including line 10-10 of FIG. 5.

Referring now to FIGS. 5, 9 and 10, it may be seen that the foregoing construction facilitates a snug, interference fit of the vertical channel 42 of the drainage tile 10 with another drainage tile 10' that has the same construction as the drainage tile 10. The slight taper of the exterior walls of the channels 42' help to permit the channels 42' of the drainage tile 10' to be initially received in the channels 42 of the drainage tiles 10. A longitudinal end section of the drainage tile 10' is overlapped with a longitudinal end section of the drainage tile 10 as shown in FIG. 5 to form a continuous drainage tile surface along the footing 16. Positioning of the drainage tiles 10, 10' just prior to being interconnected is illustrated in the exploded view of FIG. 6. As the drainage tile 10, 10' comes in lengths (e.g., 6 feet) that are shorter than the length of the footing 16, overlapping in this manner is convenient to produce an uninterrupted drainage tile span over the full length of the footing 16. It is to be understood that multiple drainage tiles can be secured together, end-to-end in this manner to cover the entire footing 16. As shown in FIG. 9, two of the vertical channels 42' of the drainage tiles 10' are received in corresponding vertical channels 42 of the drainage tile 10. Again, a slight taper on the exterior of the vertical channels 44' allows them to get started into the openings of the vertical channels 44. Similarly, two of the horizontal channels 44' of the drainage tile 10' are received in corresponding ones of the horizontal channels 44 of the drainage tile 10.

The fit of the vertical channels 42' of the drainage tile 10' in the corresponding vertical channels 42 of the drainage tile 10 and the fit of the horizontal channels 44' in the horizontal channels 44 is such that there is interference between the nested vertical channels 42, 42' and horizontal channels 44, 44' that prevents the channels from being separated without the application of some considerable manual force. For example in one embodiment, it is possible after the connection is made to pick up either one of the drainage tiles so that the overlap is lifted off the ground and turned upside down without losing the connection. It is believed that the orientation of the end walls 48, 48' of the vertical channels 42, 42' and the side walls 52, 52' of the horizontal channels 44, 44' is particularly helpful in preventing the drainage tile 10' from sliding upward with respect to drainage tile 10. The feet 32, 32' of the overlapping sections also nest in this arrangement, but do not provide an interference fit. The interference fit of the vertical and horizontal channels 42, 42', 44, 44' holds the feet 32, 32' of the overlapping sections in the nested configuration. In turn, the feet 32, 32' hold the drainage tiles 10, 10' from substantial relative movement in a plane parallel to the footing. Together, this keeps the overlapping sections of the tiles 10, 10' from separating which could cause concrete to move between the tiles, which is undesirable. It is to be understood that not both of the vertical channels 42, 42' and the horizontal channels 44, 44' need to have an interference fit.

The drainage tile 10 further includes a finish surface 60 that is located between the vertical channels 42 and the horizontal channels 44. The finish surface 60 extends the length of the drainage tile 10 and is about one inch in height. The configuration of the finish surface may be other than described within the scope of the present invention. However, it is desirable to have a smooth, flat surface that is located where the top surface of the concrete floor intersects the drainage tile 10 (see, FIG. 4). This makes it easier to get a clean, neat finish of the concrete next to the drainage tile 10. The vertical location of the finish surface 60 is preferably such that it is at a height above the footing 16 corresponding to the standard thickness of the concrete floor 12. After the floor is poured and cured, the part of the drainage tile 10 above the top surface of the floor 12 can remain. The portion of the wall section 30A above the floor 12 can serve to prevent debris from entering between the foundation wall 14 and end of the floor. Debris could block water flow down the wall 14. Moreover, the portion of the wall section 30A above the floor 12 could be used to resiliently capture a lower edge of a sheet plastic (not shown) that is put over the foundation wall 14 to create a barrier for insulation or finishing construction put over the wall.

When introducing elements of the present invention or the preferred embodiments(s) thereof, the articles "a", "an" "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A drainage device for use under a floor in a structure including the floor, a foundation wall, and a footing located below the foundation wall, the drainage device being constructed for placement on the footing adjacent to the foundation wall prior to installation of the floor to permit water to flow along the footing under the floor, the drainage device comprising a wall member having a first surface facing away from the footing and foundation wall when the drainage device is placed on the footing, and a second surface facing generally toward the footing and foundation wall when the drainage device is placed on the footing, the wall member comprising a wall section for engaging the foundation wall and a footing section for engaging the footing, a plurality of protrusions projecting outwardly from the second surface of the wall member and opening at the first surface of the wall member, at least some of the protrusions being connecting protrusions sized and shaped for an interference fit with connecting protrusions of another drainage device having the same construction so that when the drainage devices are overlapped they are connected together in a close conforming relation, the connecting protrusions including feet on the footing section and elongate channels on the wall section, at least one of the elongate channels extending at an angle to another of the elongate channels.

2. A drainage device as set forth in claim 1 wherein the connecting protrusions each comprise opposing side walls.

3. A drainage device as set forth in claim 2 wherein the side walls are arranged with respect to a plane perpendicular to the second surface of the wall member to make an angle with the plane of between about 0 to 15 degrees.

4. A drainage device as set forth in claim 3 wherein the side walls of each connection protrusion taper at an angle of about 5 degrees with respect to the plane perpendicular to the second surface of the wall member.

5. A drainage device as set forth in claim 1 wherein said one elongate channel extends generally parallel to a length of the wall member, and said other elongate channel extends generally perpendicular to the length of the wall member.

6. A drainage device as set forth in claim 5 wherein the wall section has a generally flat finish segment arranged to be positioned at the top surface of the floor to facilitate smooth finishing of the floor at the foundation wall, the finish segment being located generally between said one elongate channel extending generally parallel to a length of the wall member and said other elongate channel extending generally perpendicular to the length of the wall member.

7. A drainage device as set forth in claim 1 wherein some of the feet are sized and shaped so that they do not form an interference fit when overlapped with feet of another drainage device having the same construction.

8. A drainage device as set forth in claim 1 wherein the wall section has a generally flat finish segment arranged to be positioned at the top surface of the floor to facilitate smooth finishing of the floor at the foundation wall, the finish segment being located generally between said one elongate channel and said other elongate channel extending at an angle to said one elongate channel.

9. A drainage device as set forth in claim 8 wherein the finish segment has a height corresponding to a range of standard floor pour depths.

10. A drainage device as set forth in claim 1 wherein the feet are adapted for nesting with feet of an overlapped portion of an identical drainage device.

* * * * *